US006428383B1

(12) United States Patent
Allmon et al.

(10) Patent No.: US 6,428,383 B1
(45) Date of Patent: Aug. 6, 2002

(54) REMOTE CONTROL MODEL VEHICLE WITH AUDIO OUTPUT SYSTEM

(76) Inventors: Stanley W. Allmon; Jerry D. Swiney, both of 914 Selma St., Little Rock, AR (US) 72202

( * ) Notice: Subject to any disclaimer, the term of this patent is extended or adjusted under 35 U.S.C. 154(b) by 0 days.

(21) Appl. No.: 10/022,386

(22) Filed: Dec. 20, 2001

Related U.S. Application Data

(60) Provisional application No. 60/258,014, filed on Dec. 27, 2000.

(51) Int. Cl.[7] ..... A63H 17/36

(52) U.S. Cl. ..... 446/460; 446/454; 446/71; 446/81

(58) Field of Search ..... 446/71, 76, 81, 446/431, 436, 448, 454, 456, 457, 460, 465, 470

(56) References Cited

U.S. PATENT DOCUMENTS

| | | | | | |
|---|---|---|---|---|---|
| 3,961,441 | A | * | 6/1976 | Sato | 446/175 |
| 4,165,581 | A | * | 8/1979 | Wolf | 446/175 |
| 4,219,962 | A | * | 9/1980 | Dankman et al. | 331/111 |
| 4,865,575 | A | * | 9/1989 | Rosenthal | 446/175 |
| 5,024,626 | A | * | 6/1991 | Robbins et al. | 446/409 |
| 5,045,016 | A | * | 9/1991 | Stern et al. | 446/409 |
| 5,046,981 | A | * | 9/1991 | Roddy | 446/409 |
| 5,195,920 | A | * | 3/1993 | Collier | 446/175 |
| 5,292,275 | A | * | 3/1994 | Swisher et al. | 446/409 |
| 5,389,031 | A | | 2/1995 | Sharpe, III et al. | |
| D366,296 | S | | 1/1996 | Novak | |
| 5,512,001 | A | | 4/1996 | Kent et al. | |
| 5,555,815 | A | * | 9/1996 | Young et al. | 104/296 |
| 5,632,375 | A | | 5/1997 | Mattikow | |

FOREIGN PATENT DOCUMENTS

| | | |
|---|---|---|
| GB | 2063692 | 6/1981 |
| GB | 2248191 | 4/1992 |
| GB | 2278064 | 11/1994 |

* cited by examiner

*Primary Examiner*—Jacob K. Ackun
*Assistant Examiner*—Bena B. Miller
(74) *Attorney, Agent, or Firm*—Richard C. Litman

(57) ABSTRACT

A remotely controllable model vehicle includes one or more audio output or playback devices onboard. The model vehicle may have a cassette player, CD player, and/or AM/FM radio contained therein, for selectively providing audio output according to the desire of the operator of the model. Conventional speed and directional control systems are also provided. The operator of the model selects the audio system to be used and installs the appropriate media (tape, CD, etc.) or tunes the radio as desired, and operates the vehicle to provide a mobile audio program according to the travel of the model. Additional functions (lights, horn, clock or timer, etc.) may also be included. The present model vehicle is particularly valuable for advertising and entertainment wherever crowds may gather, such as remote live radio broadcast shows, store openings, parties, dances, etc.

19 Claims, 7 Drawing Sheets

REMOTE CONTROL MODEL VEHICLE WITH AUDIO OUTPUT SYSTEM

CROSS-REFERENCE TO RELATED APPLICATION

This application claims the benefit of U.S. Provisional Patent Application Serial No. 60/258,014, filed Dec. 27, 2000.

BACKGROUND OF THE INVENTION

1. Field of the Invention

The present invention relates generally to remotely controlled models, toys, and the like, and more specifically to a radio controlled model automobile having various audio output systems on board. The operator of the model manually selects the type of audio system to be used (i. e., tape cassette or CD insertion, or AM/FM radio tuning), with a conventional radio control system providing speed and directional control of the model, as well as audio output volume and other functions.

2. Description of the Related Art

Radio controlled model cars, boats, and aircraft are increasingly popular hobbies with many people, due to the level of skill required in their construction and operation, the competition offered in some areas, and various other reasons. Many car, boat, and aircraft models come completely assembled and ready for use, for hobbyists who do not wish to spend time building such models.

Many such radio controlled models have become highly specialized, with various features providing further novelty, entertainment, and advertising value. One environment in which radio controlled model cars would be especially valuable, is the live radio broadcast entertainment industry. Live broadcasts from various sites remotely located from the studio, feature a DJ to provide music who also entertains the live audience in various ways. The use of a radio controlled vehicle, particularly one which incorporates an audio output system to play music selected by the DJ, would prove to be an especially valuable tool for attracting a live audience to the show. Such a vehicle would also find a niche at parties, dances, and other related social activities, particularly those in which an automotive theme might be an appropriate accent for the gathering.

Accordingly, a need will be seen for a remotely controlled model vehicle which includes an audio output system, for use at parties, remote radio broadcast shows, store openings, and other environments where such a vehicle, with its audio output, will attract and entertain a crowd. The present radio controlled vehicle is in the form of a model automobile, providing greater versatility for operation in most environments where its use is desired. The present model incorporates various audio output systems for play during its operation, as well as other features.

A discussion of the related art of which the present inventor is aware, and its differences and distinctions from the present invention, is provided below.

U.S. Pat. No. 5,024,626 issued on Jun. 18, 1991 to Jack Robbins et al., titled "Sound Producing Remote Control Toy Vehicle," describes a model automobile having various functions controlled by a hard wired controller, rather than using radio control as in the case of the preferred embodiment of the present remotely controlled model vehicle. Even if the Robbins et al. model had the range provided by radio control, all of the sound emanates from a single speaker within the hand held control unit of the system, rather than from the model vehicle itself. This greatly limits the value of the Robbins et al. model only to entertainment of one, or at most a very few, people, rather than providing entertainment for a larger group of people, as can the present model vehicle invention. In addition, while Robbins et al. provide a horn and other vehicle sounds for their model, these sounds are not realistically deployed, as they do not emanate from the vehicle itself. The Robbins et al. model also has no provision whatsoever for any form of live or recorded audio playback, as provided by the present remotely controlled model vehicle. The sounds which may be reproduced by the hand held unit of the Robbins et al. system, are severely limited to only a relatively few sounds simulating the mechanical sounds of a full scale automobile, and cannot be changed at will. In contrast, the present remotely controlled model vehicle incorporates audio output systems (radio, tape, CD) enabling the operator to change the recording or radio reception as desired.

U.S. Pat. No. 5,046,981 issued on Sep. 10, 1991 to Kenneth A. Roddy, titled "Toy Vehicle With Remotely Driven Speaker And Plural Bodies," describes a cable controlled model vehicle in which the audio output is provided from the model vehicle itself. The operator of the toy controls the speed and direction of the model by means of a controller hard wired to the vehicle, rather than using radio control, as in the preferred embodiment of the present remotely controlled model vehicle invention. The Roddy system enables the operator to input any type of audio desired to the speakers in the vehicle, but the audio system is contained within the hand held controller device of the system, rather than within the vehicle, as in the present invention. This results in the audio signal, as well as control signals, being transmitted by means of the hard wire connection between the controller and the model. The necessity of transmitting all of the audio signal to the vehicle from the hand held controller, results in a hard wire link between the two being the only practicable connection. The broadcast of the audio program from the hand held controller to the model vehicle, would be impracticable due to the power limitations imposed by the FCC for such audio broadcasts, as well as the considerably greater bandwidth required for such an audio broadcast over and above the relatively narrow bandwidth required merely for model vehicle control purposes. The present invention overcomes this hard wiring limitation while still providing audio output from the model, by placing all audio output and playback components in the model itself, rather than in the hand held controller.

U.S. Pat. No. 5,389,031 issued on Feb. 14, 1995 to Henry D. Sharpe III et al., titled "Toy Assembly," describes a vehicle model having audio output means, but the audio output is severely limited to only a relatively few different sounds. Moreover, no remote control of vehicle motion or the audio system is provided by Sharpe III et al. Rather, the sounds of their model are controlled by switches located directly upon the vehicle, with those switches having cooperating configurations for actuation by various accessories (e.g., model fireman, fire hose, dog, etc., in the case of a model fire truck). No operator selectible audio programming is provided, nor is any means of remotely controlling the vehicle or any other functions of the vehicle provided by Sharpe III et al., which audio selection and remote vehicle control are features of the present invention.

U.S. Pat. No. 5,512,001 issued on Apr. 30, 1996 to Michael Kent et al., titled "Toy Vehicle," describes a model capable of producing a limited number of predetermined vehicle mechanical sounds and simulated exhaust smoke. No remote control of the vehicle is provided, as Kent et al.

do not provide any motive power for their toy. All control input must be accomplished by controls mounted directly on the model itself. Moreover, no means for audio playback of operator selected programs (either live or prerecorded) is provided by Kent et al. for their model vehicle, whereas the operator of the present model vehicle may select a prerecorded audio program (tape or CD) or live radio broadcast for playback from the model.

U.S. Pat. No. 5,632,375 issued on May 27, 1997 to Nina J. Mattikow, titled "Combined Functional Toy And Cassette Holder," describes a device for holding a single audio cassette or the like, with the holder device having a vehicle (school bus, locomotive, etc.) configuration in some embodiments. No means of playing the cassette or sound recording stored in the holder, is provided; the device functions only as a holder for an audio recording, with an external configuration for use as a vehicle or other toy. Also, no remote control means is disclosed by Mattikow, as no motive power or other functions are provided for the cassette holder toy device.

U.S. Pat. No. D-366,296 issued on Jan. 16, 1996 to Joseph R. Novak, titled "Remote Control Model Car," illustrates a model vehicle design resembling a 1955 Chevrolet. No motive power, audio output, control means, or any other function is disclosed in the '296 Design Patent It is noted that each side of the design depicts a pair of concentric circular patterns. However, these do not appear to suggest speakers or other functional devices, but rather appear to align generally with the relatively large protrusions on the front and rear bumpers of the model, suggesting targets or aiming points for colliding one such model with another.

British Patent Publication No. 2,063,692 published on Jun. 10, 1981 to C. P. G. Products Corp., titled "Toy Vehicle," describes a relatively limited toy function wherein the cyclic closure of electrical contacts produces a sound simulating the cyclic release of steam from a steam locomotive engine. No motive power or remotely controllable operation of the toy is disclosed in the '692 British Publication. Moreover, only a single, invariable sound is produced by the device; the audio output cannot be adjusted or changed by the user, as provided by the user selectible audio programs played by the audio output system of the present device.

British Patent Publication No. 2,248,191 published on Apr. 1, 1992 to Tomy Company Ltd., titled "A Key Action, Movable Toy," describes a toy automobile capable of producing a limited number of different sounds simulating automobile operation (starting, idling, and vehicle movement). All controls are located on the model itself; no remote control of any function is provided. While the device includes steering input, once the vehicle mounted steering wheel is set, the path of the vehicle is set accordingly. It cannot be adjusted or changed remotely, as provided by the present remotely controlled model. Moreover, the Tomy Company model has no provision for user selectible audio output, as provided by the present model. Rather, the Tomy Company model has only a limited set of permanently programmed sounds simulating engine starting and operation, which sounds cannot be changed by the operator.

Finally, British Patent Publication No. 2,278,064 published on Nov. 23, 1994 to Kang Chong To, titled "Radio Controlled Car With Rotatable Driver," describes a radio control model chassis having four wheel steering and a drive motor. However, no sound system is described in the '064 British Publication, as provided by the present remote control model vehicle invention.

None of the above inventions and patents, either singly or in combination, is seen to describe the instant invention as claimed.

SUMMARY OF THE INVENTION

The present invention comprises a remotely controllable model vehicle, with the vehicle including an audio output system therein and other features. The present remotely controlled model is particularly well suited as an entertainment device in relatively large and open environments, where the model may be programmed with either prerecorded or live audio output (tape or CD player, or radio), with the audio output means being carried aboard the model. The model may then be operated through the area, to play the selected music or other programming as desired. The provision of the audio playback means aboard the model is achieved by the relatively light weight and small size achieved by state of the art units, and obviates any requirement for the playback equipment to be carried by the operator or placed outside the model. This greatly reduces the bandwidth required for signals to the model, as no audio recording signals need be broadcast to the model. This also greatly expands the range achievable by the model, as FCC regulations greatly restrict the power output of noncommercial audio broadcast signals.

The operator of the present model vehicle need only select the type of audio output to be played and configure the vehicle accordingly, i.e., insert a conventional cassette tape or CD into the onboard player, or tune the onboard radio to the desired frequency. The model may then be operated across the desired area to play the music or other programming selected by the operator. Other features (operable lights horn, etc.) may also be provided.

Accordingly, it is a principal object of the invention to provide an improved remote control model vehicle with an audio output system, for use as an entertainment and recreational device.

It is another object of the invention to provide an improved remote control model vehicle having radio control means for controlling the speed and direction of the model.

It is a further object of the invention to provide an improved remote control model vehicle including at least one audio playback means contained aboard the vehicle.

An additional object of the invention is to provide an improved remote control model vehicle having audio playback means consisting of one or more devices, such as an audio cassette player, CD player, and/or AM/FM radio, with the operator of the model selecting and/or tuning the audio device to be used for any given period of operation.

Still another object of the invention is to provide an improved remote control model vehicle which may include additional functions such as operable lighting, horn, and/or clock or timer means as well.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention is a remotely controllable model vehicle, including various audio and visual features providing entertainment and other functions as well. The present remotely controlled vehicle preferably makes use of conventional radio control model control systems for controlling at least the direction and speed of the vehicle, with various other systems installed in the vehicle as well. However, it will be seen that other types of control systems (e.g., electrical or mechanical cable, etc.) may be used if desired, at the expense of the longer range provided by radio control systems. The present vehicle includes an audio output system, with the apparatus being installable in various types of model vehicles, including boats. However, the present remotely controlled model vehicle is preferably in the form of a wheeled vehicle, particularly a model automobile, such as the automobile model 10 illustrated particularly in FIG. 1 of the drawings.

The automobile model 10 includes a series of additional electrical and electronic components, in addition to the control system noted above. The present vehicle 10 is intended for entertainment and display purposes, and includes at least one (and preferably several different) audio output systems, allowing the model 10 to be operated in an area at some distance from the operator, while playing music, an advertising message, etc. from the model 10 as it travels through the area and is seen and heard by persons in the vicinity.

Figure 1:
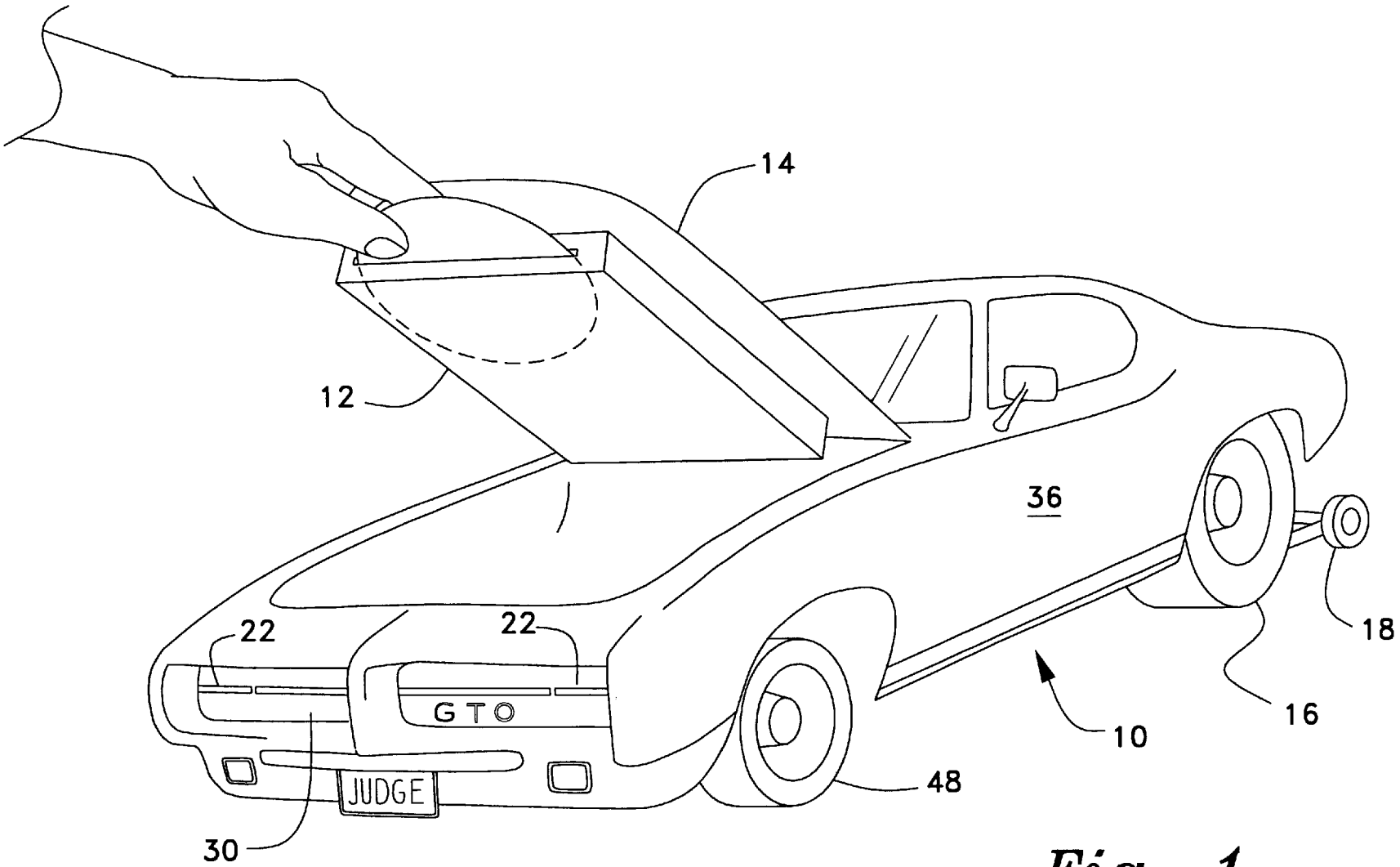
FIG. 1 is an environmental perspective view of the present remote control model vehicle, showing the insertion of a CD into the CD player of the model.

FIG. 1 of the drawings illustrates the provision for a compact disc (CD) player in the model. Such a CD deck 12 may be installed beneath the openable hood 14 of the model 10, as shown. The volume beneath the hood of the model 10 provides sufficient volume for the installation of a relatively compact CD player 12 therein, essentially as shown. The model 10 may be provided in any practicable scale, but a scale of 1:12 results in a model having a length of approximately fifteen inches and a width of approximately six inches for an exemplary model 10 such as the late '60s Pontiac GTO illustrated in the accompanying drawings. Such a size provides more than sufficient interior volume for receivers, tuners, amplifiers, and speakers associated with various compact audio output systems. However, it will be seen that if further miniaturization of componentry is achieved, and/or fewer components are installed in the model, that the model may be constructed to a smaller scale, if so desired. Alternatively, the present model vehicle may be scaled up to a larger scale, if so desired.

Figure 2:
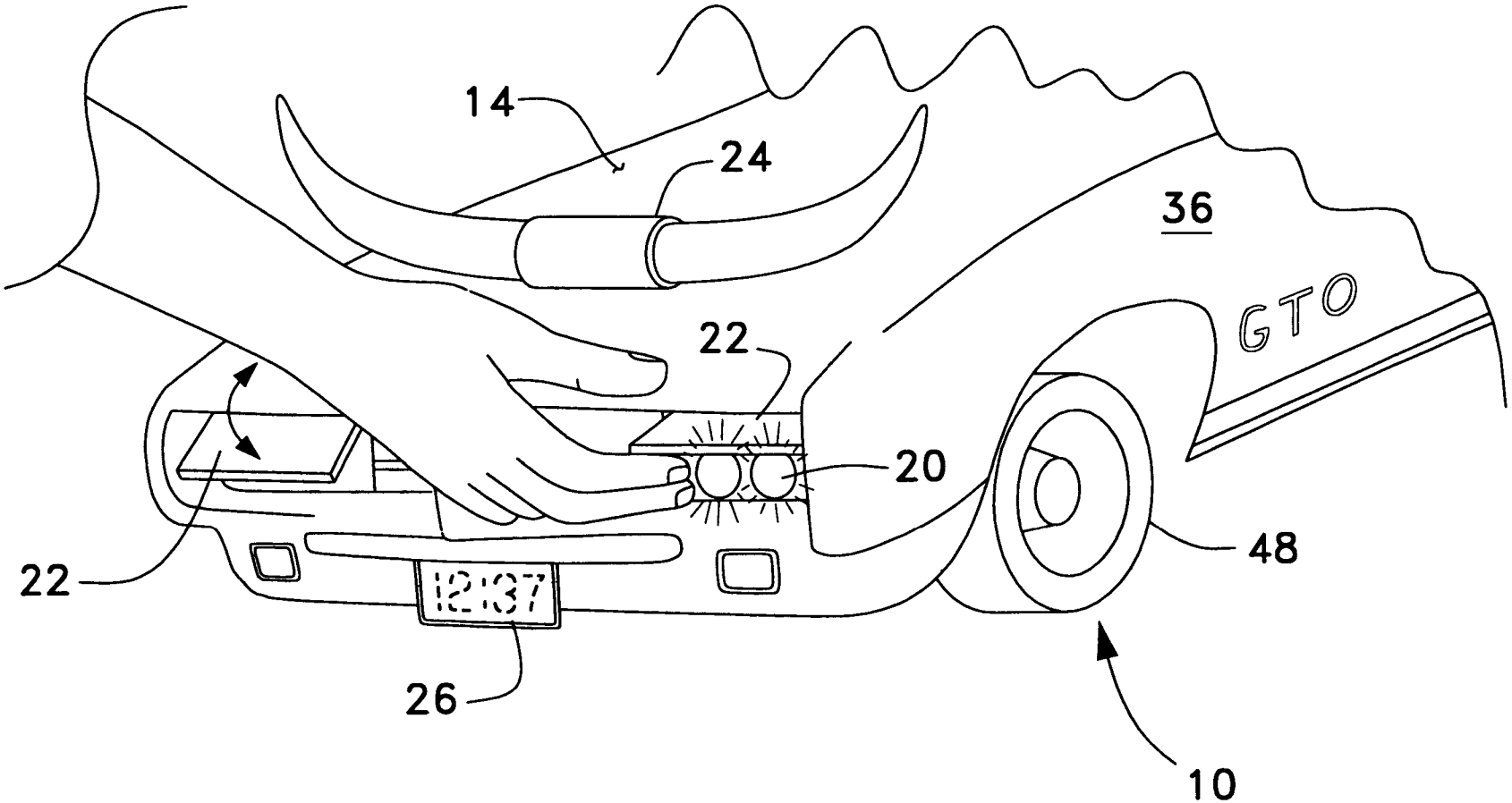
FIG. 2 is a broken away front perspective view of the present model vehicle, showing the actuation of the lights provided therewith and the clock or timer display.

Preferably, the vehicle model 10 is representative of a somewhat "customized" car, and includes visual features such as larger rear tires 16, "wheelie" bars 18, etc. as desired. FIG. 2 shows further functional and decorative features of the present model vehicle 10, wherein a lighting system is provided. As all full size automobiles are equipped with headlights, the present model vehicle 10 may also be equipped with lighting means 20 as well. These lights 20 may be actuated by opening the miniature headlight doors 22, as shown in FIG. 2 of the drawings and as provided on the full scale vehicle upon which the model 10 is based. Other headlight actuation means may be provided as desired (e.g., a switch/switches disposed on, within, or beneath the body, etc.), but the actuation of the headlights 20 by means of the openable and closable headlight covers or doors 22, adds a realistic touch to the model 10. The lighting means 20 are preferably sufficiently bright and sufficiently narrowly focussed, as to serve as a flashlight or other supplemental lighting means as required.

Another "customizing" detail which may be provided with the vehicle 10, is the installation of a pair of model longhorn steer horns 24 on the hood 14. Such a flamboyant detail adds considerably to the customized appearance of the model vehicle 10, serving to draw further attention to the model, just as full scale customized vehicles attract attention. However, the model steer horns 24 may serve an additional purpose, due to their configuration. The horns 24 may be made to be removable from the hood 14 of the model 10, if so desired, by means of a conventional plug and socket or other arrangement. The length of the horns 24, when constructed to a size approximately as indicated in FIG. 2 for a 1:12 scale automobile model, corresponds quite well to the length of a conventional portable telephone receiver. One end of the horns 24 may include a miniaturized microphone to serve as a mouthpiece, with the opposite end having a miniature speaker therein to serve as the earpiece for the phone. The central juncture of the two horns acts as the hand grip for the horn/phone 24. The relatively small volume of the horns 24 need not contain all of the telephone componentry (e.g., keypad, amplifier, transmitter, etc.), but may contain only a speaker and receiver, with the phone 24 being wired back to the keypad and other componentry contained within the larger volume of the model 10. Access may be gained to such componentry by removing the body shell from the underlying chassis, as is explained further below in describing various internal components.

FIG. 2 also illustrates another feature which may be provided with the present model 10. The display area of the front license plate (and rear plate, as well) may be used as a clock or timer display 26. The display 26 may indicate real time, or may serve as the readout for a radio broadcast frequency tuned on the onboard receiver (described further below), numerical readout for a telephone number selected, etc., as desired and depending upon the electronics provided on board.

Figure 3:
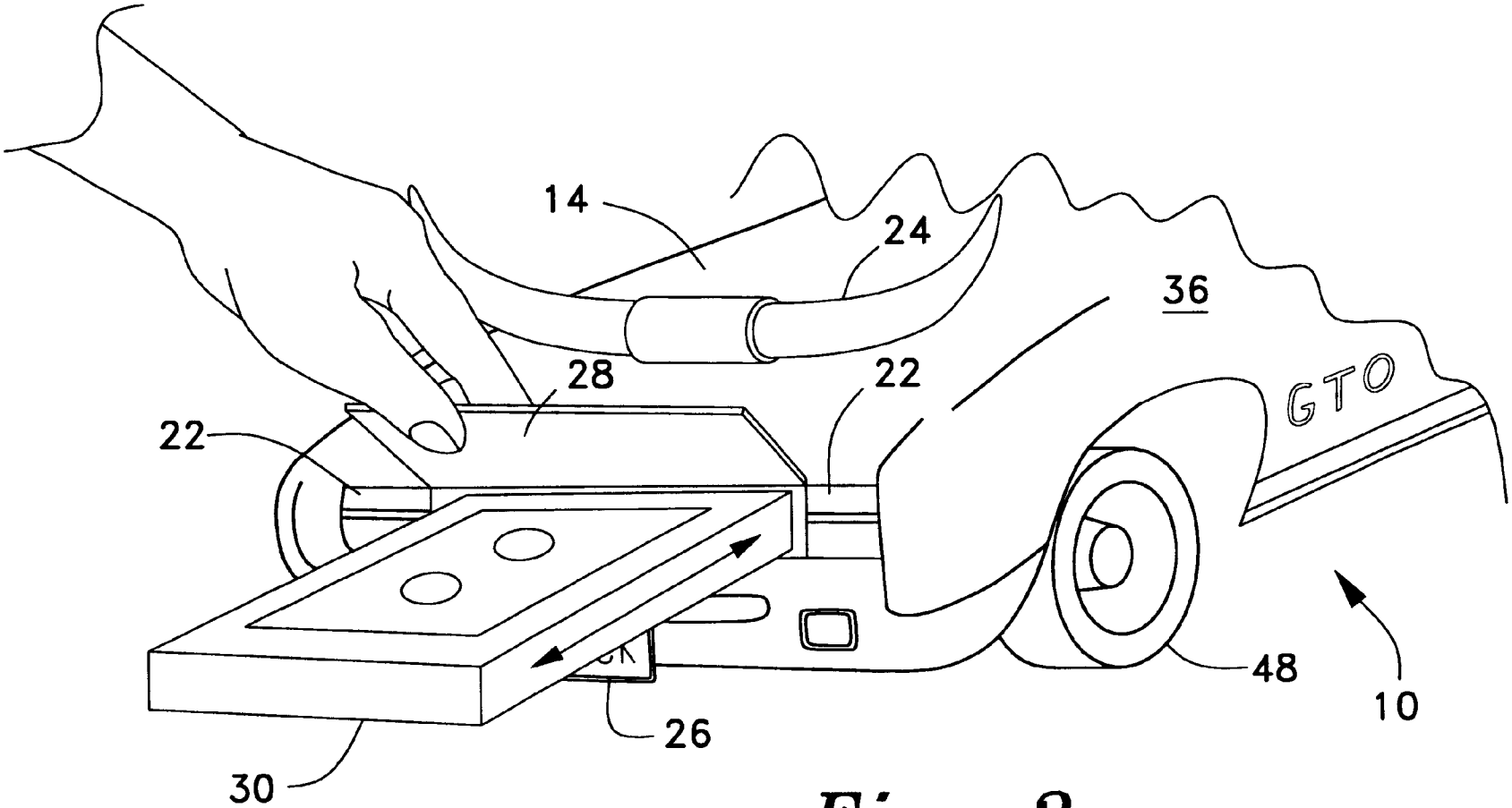
FIG. 3 is a broken away front perspective view of the present model vehicle, showing the insertion or removal of an audio tape cassette from the grille of the model.

As noted further above, the interior volume of a 1:12 scale model automobile provides a considerable amount of interior volume for the containment of various electronic systems. FIG. 3 further illustrates provision for a tape cassette player (designated with the CD player as component 12, in FIG. 5 of the drawings), with access being gained by means of an openable grille 28 between the two headlight covers or doors 22. A tape cassette 30 may be installed or removed conventionally in the cassette slot of a tape player installed immediately behind the grille 28, with the grille 28 serving as the tape access door for the player, as is known in the art.

Figure 4:
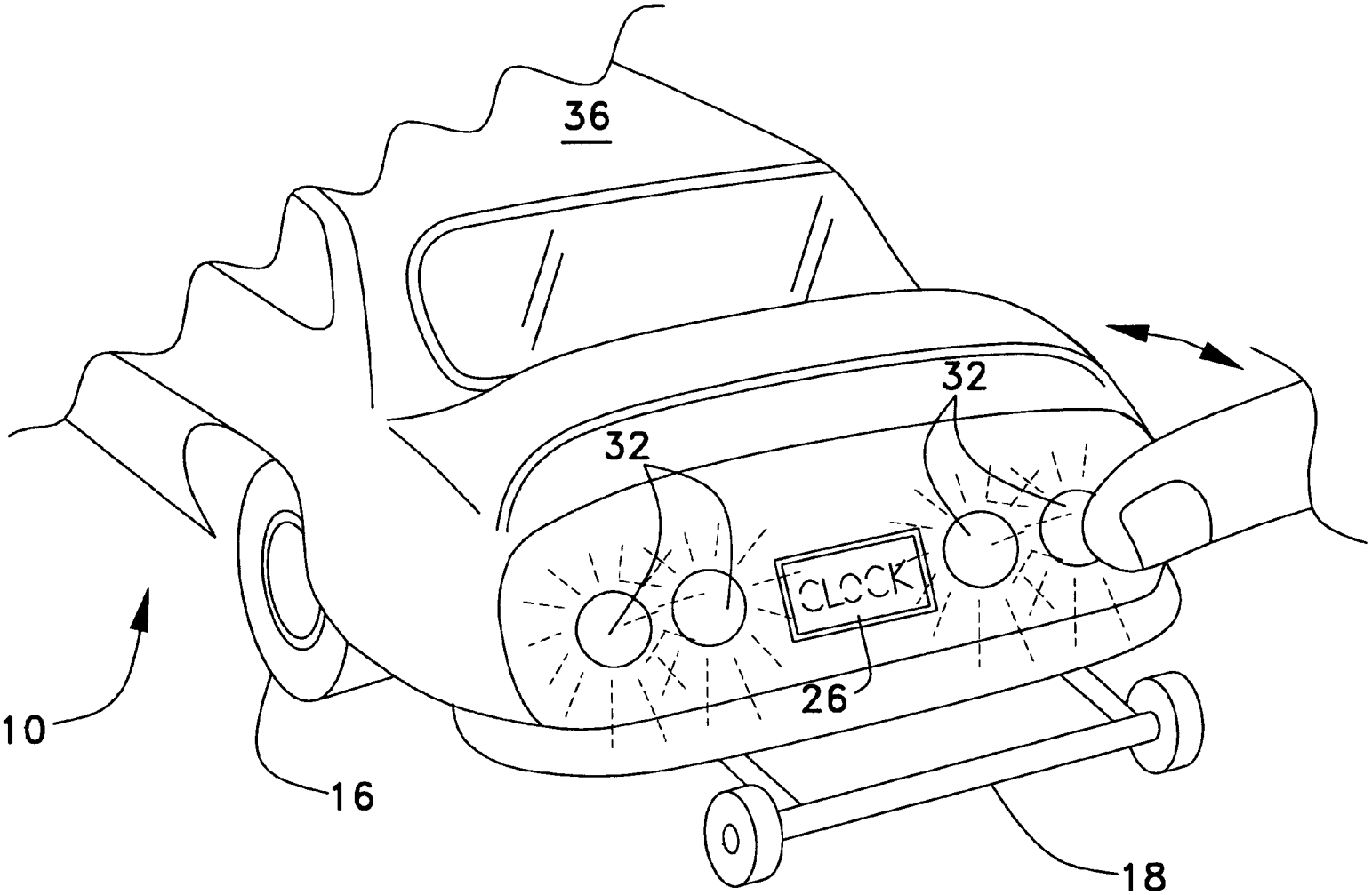
FIG. 4 is a broken away rear perspective view of the present model vehicle, illustrating the actuation of the tail lights and rearwardly disposed clock or timer display.

FIG. 4 provides a rear perspective view of the present model vehicle 10, illustrating further details thereof. In FIG. 4, the tail lights 32 of the model 10 are shown being activated, as by conventional pushbutton on/off switches therebehind. The tail lights 32 may include a conventional flasher circuit to allow them to pulsate or flash at regular intervals, and/or may be configured to provide a steady light when activated, as desired. The location of the rear license plate may also provide for a clock or timer display 26, just as in the case of the front plate location shown in FIG. 2 of the drawings. The two timers or clocks 26 may be connected together to provide identical displays, or may be independent units to show different information, as desired.

Figure 5:
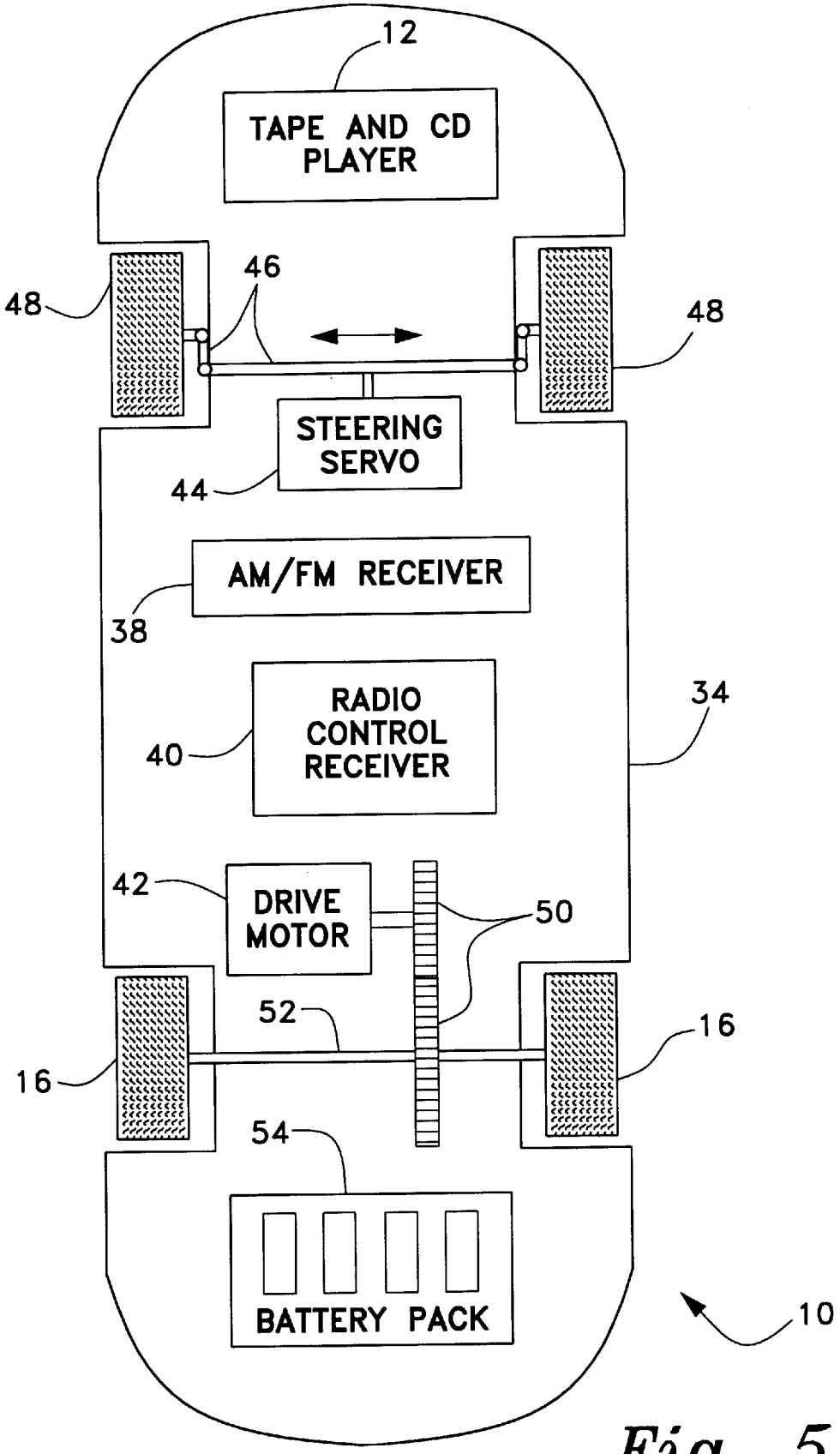
FIG. 5 is a schematic top plan view of the chassis of the present model vehicle with the outer body shell removed, showing the functional componentry of the model.

FIG. 5 provides a top plan view of the chassis 34 and various operational componentry of the present model vehicle 10, with the body 36 removed therefrom. The front portion of the chassis 34 contains the CD and/or tape player unit or units 14, as previously discussed further above. (It should be noted that FIG. 5 is schematic in nature, and that the componentry is not necessarily drawn to scale.) An AM/FM radio receiver 38 may also be provided on board the vehicle 10, if so desired. The heart of the system is a radio control receiver 40, which receives appropriate signals from a conventional transmitter (shown in FIG. 7) and provides appropriate control signals to the drive motor 42 to control the speed of the model 10 and to a steering servo 44 for directional control of the model via an appropriate linkage 46 and the steerable wheel(s) 48.

The drive motor 42 drives the rear wheels 16 (or wheel, in the case of a model having a single drive wheel) by means of a gear train 50 and drive axle 52. The gear ratio may be selected as desired to provide the desired acceleration and top speed characteristics, depending upon tire 16 diameter and motor 42 speed. Various means may be used to control the rotational speed of the motor 42, e.g., variable frequency, voltage control, etc., as is known in the art. Typically, the motor 42 provides considerable counter electromotive force when power is reduced, thus providing sufficient braking action for a relatively lightweight model vehicle 10. However, additional conventional braking means, e.g., a disc brake (not shown) on the drive axle 52, etc., may be provided as required. The above described electronic componentry shown in FIGS. 1 through 5 is powered by a conventional battery pack 54 (dry cells, rechargeable nicads, etc.) which may be placed on the chassis 34 in any convenient volume contained by the body 36 when installed.

Figure 6:
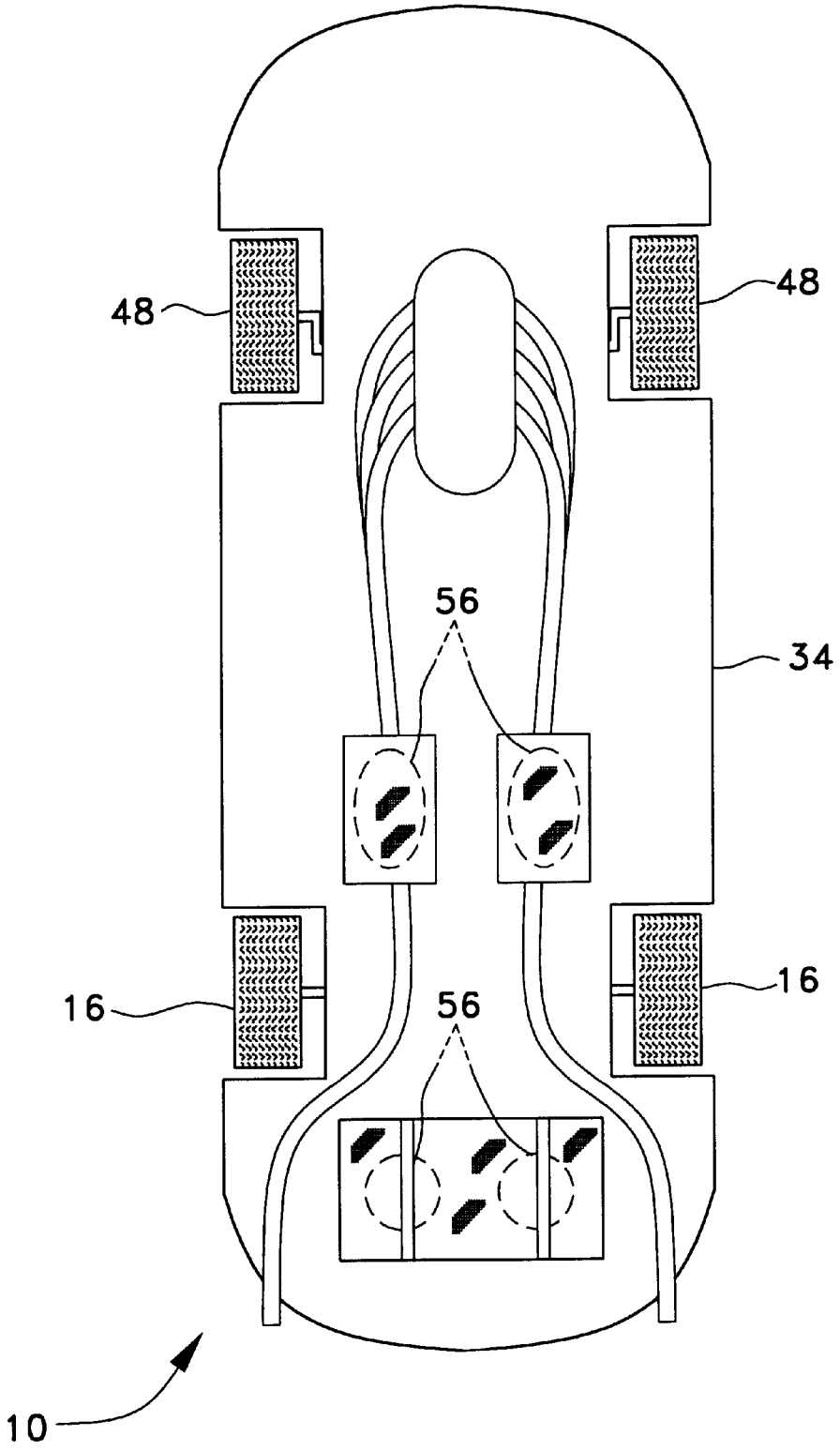
FIG. 6 is a bottom plan view of the chassis of the present model vehicle, showing the audio speaker configuration therein.

FIG. 6 provides a bottom plan view of the chassis, illustrating the audio output for the present model vehicle 10. In FIG. 6, one or more audio speakers 56 (preferably a plurality thereof) is provided beneath the chassis 34. These speakers 56 are preferably relatively small but powerful, with the weight of their magnets and coils being placed low in the chassis 34 for good weight distribution. A convenient location providing the required volume for such speakers 56 is in the area where the mufflers and fuel tank are located on a full scale automobile, as shown in FIG. 6. These areas contain only the speakers 56 in the present model vehicle 10, and are preferably covered with a conventional protective speaker cloth or screen, as indicated by the crosshatched areas over the speakers 56 in FIG. 6. While the audio output of the speakers 56 is projected downwardly beneath the model 10, the reflection of the sound output provides quite satisfactory audio output from the model 10, particularly when the model is operated on a relatively hard surface (tile, hardwood, vinyl flooring, etc.).

Figure 7:
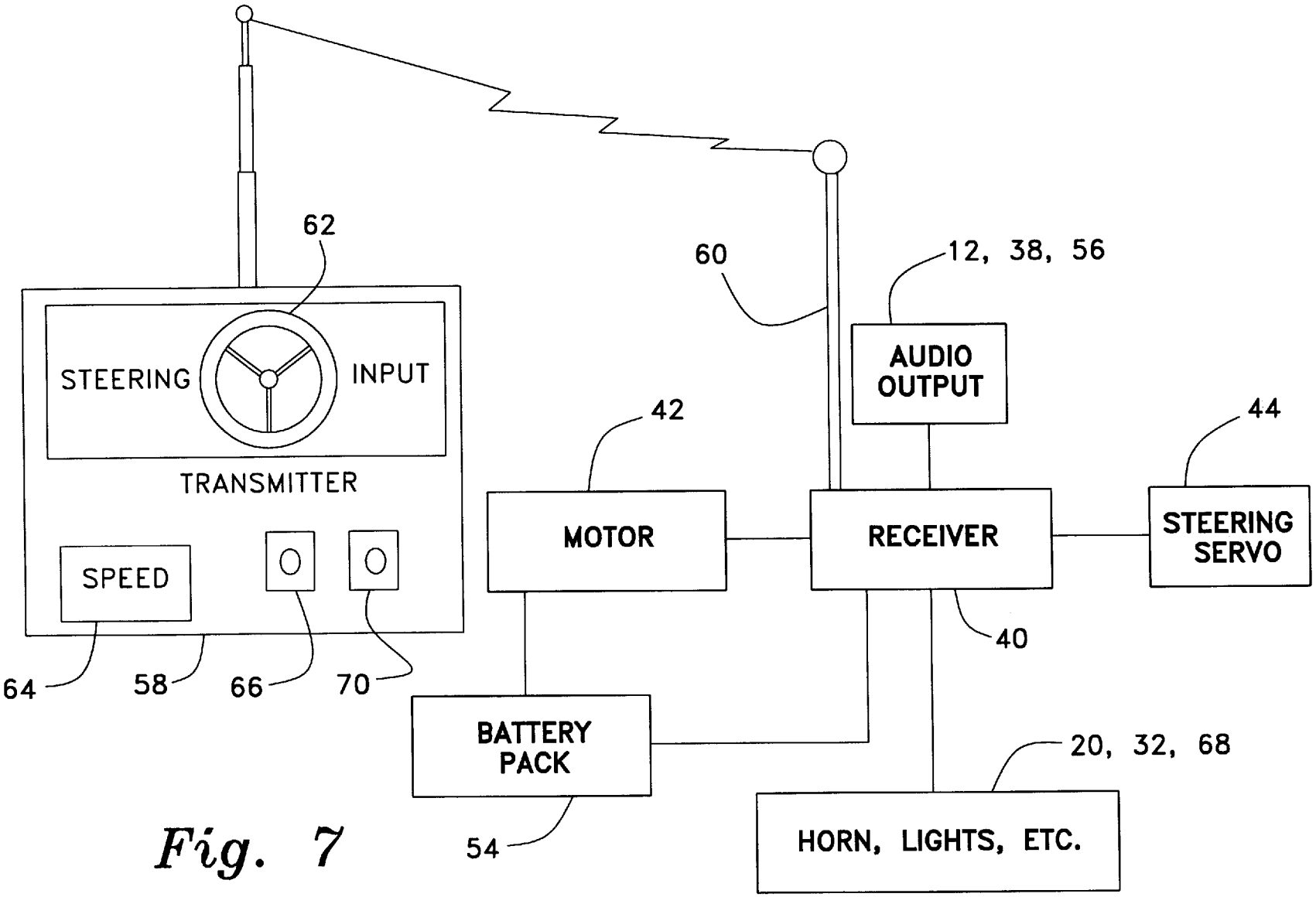
FIG. 7 is a block diagram showing the interrelationship of the functional componentry of the present model vehicle, and the control means for operating the various systems of the model.

FIG. 7 provides a schematic view of the basic electronic componentry of the present model 10 and its operating systems. The componentry contained aboard the model 10 is shown generally to the right side of the drawing Figure, and is interconnected by a series of lines representing appropriate electrical wiring between the components. It will be understood that this Figure is not an electrical schematic, and that the interconnections are shown only generally; considerably more wiring is required for operability. The receiver 40 receives radio frequency control signals from a transmitter 58, shown to the left side of the drawing Figure, via an antenna 60. The antenna 60 is not illustrated in other drawing Figures, as the preferred plastic body shell 36 is essentially transparent to radio frequencies, and accordingly, the receiver antenna 60 and other antennae required for telephone operation, etc. may be enclosed beneath the body shell 36 during operation of the model vehicle 10.

The receiver 40 controls the other componentry according to input from the transmitter 58 as desired by the operator of the transmitter 58, as is conventionally known in the art of radio controlled model vehicles. For example, when the operator desires to turn the model 10 to the left or right, he/she may do so by means of the steering control 62 on the transmitter 58. A digital proportional signal is sent from the transmitter 58 to the receiver 40 aboard the model 10, which converts and relays the signal as required to the steering servo 44, to drive the servo 44 in the selected direction, amplitude, and/or rate to accomplish the maneuver. In much the same manner, speed control of the drive motor 42 is accomplished by means of an appropriate speed control 64 on the transmitter 58, e.g., a signal selectively increasing or decreasing electrical frequency or voltage to the motor 42, etc., as is conventional in the art.

In much the same manner, the transmitter 58 may be used to control at least the volume of the audio output, comprising the CD and tape players 12 and/or AM/FM receiver 38 and speakers 56. Preferably, the audio media (CD, tape, or AM/FM radio output) is selected by hand by the operator, e.g., inserting a disc in the CD player or tape in the tape player, or tuning the radio as desired. However, the volume of the audio output is easily controlled by remote control means, as is known in the art, and may be accomplished using a volume control 66 on the transmitter 58, as desired.

In much the same manner, the model automobile 10 may be equipped with a horn (shown schematically in FIG. 7 as component 68, with the lights 20 and 32) which may be selectively activated by means of a horn button control 70 on the transmitter 58. While the lights 20 and 32 were described further above as being activated by hand, it will be seen that additional remotely actuated controls (not shown) are easily provided, for remote control of such accessories in addition to the horn 68, if so desired. Such remotely actuated on/off controls are well known, e.g., by sending a pulse to a switching transistor for alternately actuating an on/off accessory (e.g., lights 20 and/or 32), or sending a continuous signal to maintain actuation of a device (e.g., horn 68). The horn 68 may represent a conventional automobile horn sound, or may be made to have virtually any sound desired (e.g., music, animal sound, such as a cow or steer), etc., by means of solid state audio chips commonly available or easily programmable with the sound desired.

In conclusion, the present remotely controlled vehicle model provides a popular attraction for various gatherings, such as remote on site radio broadcasts at various venues, store openings, parties, etc. The use of radio control for the model provides significantly greater range over hard wire or cable control, for use in parking lots and other relatively large areas. Yet, the audio systems incorporated with the present model require no additional bandwidth or licensing requirements than conventional radio control model equipment, as the audio signal is not transmitted between the transmitter and the model. Rather, all audio equipment remains on board the model, with the only remote control required being for control of the volume of the preselected audio output.

Accordingly, the equipment and licensing requirements for the present model are relatively economical, being essentially identical to such requirements for other radio control model cars, boats, and aircraft. The inventive concept of providing all audio systems in the model itself, rather than transmitting the audio signal to the model, opens the availability of the present model to a much greater number of potential purchasers and users than would be the case with other configurations, and the present model with its audio system will enjoy widespread popularity not achievable with other mobile audio systems.

It is to be understood that the present invention is not limited to the embodiments described above, but encompasses any and all embodiments within the scope of the following claims.

We claim:

1. A remote control model vehicle, comprising:

a chassis;

a remotely controlled drive motor disposed upon said chassis;

remotely controlled steering means disposed upon said chassis;

at least one operator programmable audio output means for outputting audio disposed upon said chassis;

said audio output means having a volume control; and operator controlled means remotely disposed from said chassis for remotely and selectively controlling said drive motor, said steering means, and said volume control of said audio output means.

2. The remote control model vehicle according to claim 1, further including:

radio control receiver means disposed upon said chassis, for selectively controlling said drive motor, said steering means, and said volume control of said audio output means; and said operator controlled means comprising a radio control transmitter for remotely controlling at least said drive motor, said steering means, and said volume of said audio output means by radio signal input to said radio control receiver means.

3. The remote control model vehicle according to claim 1, further including:

a plurality of wheels extending from said chassis;

said wheels including at least one driven wheel and at least one directionally steerable wheel;

said remotely controllable drive motor selectively driving said at least one driven wheel; and said remotely controllable steering means selectively controlling said at least one directionally steerable wheel.

4. The remote control model vehicle according to claim 1, wherein said audio output means is selected from the group consisting of tape cassette players, CD players, and AM/FM radio receivers.

5. The remote control model vehicle according to claim 1, further including selectively operable forwardly and rearwardly disposed lighting means respectively simulating motor vehicle headlights and tail lights.

6. The remote control model vehicle according to claim 1, further including selectively operable audible horn means.

7. The remote control model vehicle according to claim 1, further including time display means.

8. A remote control model vehicle, comprising:

a chassis;

a plurality of wheels extending from said chassis;

said wheels including at least one driven wheel and at least one directionally steerable wheel;

a remotely controllable drive motor disposed upon said chassis and selectively driving said at least one driven wheel;

remotely controllable steering means disposed upon said chassis and selectively controlling said at least one directionally steerable wheel;

at least one operator programmable audio output means for outputting audio disposed upon said chassis;

said audio output means having at least a volume control; and operator controlled means remotely disposed from said chassis for remotely controlling said drive motor, said steering means, and at least said volume control of said audio output means.

9. The remote control model vehicle according to claim 8, further including:

radio control receiver means disposed upon said chassis, for selectively controlling at least said drive motor, said steering means, and said volume control of said audio output means; and said operator controlled means comprising a radio control transmitter for remotely controlling at least said drive motor, said steering means, and said volume control of said audio output means by radio signal input to said radio control receiver means.

10. The remote control model vehicle according to claim 8, wherein said audio output means is selected from the group consisting of tape cassette players, CD players, and AM/FM radio receivers.

11. The remote control model vehicle according to claim 8, further including selectively operable forwardly and rearwardly disposed lighting means respectively simulating motor vehicle headlights and tail lights.

12. The remote control model vehicle according to claim 8, further including selectively operable audible horn means.

13. The remote control model vehicle according to claim 8, further including time display means.

14. A remote control model vehicle, comprising:

a chassis;

a remotely controllable drive motor disposed upon said chassis;

remotely controllable steering means disposed upon said chassis;

at least one operator programmable audio output means for outputting audio disposed upon said chassis;

said audio output means having at least a volume control;

radio control receiver means disposed upon said chassis, for selectively controlling at least said drive motor, said steering means, and said volume control of said audio output means; and operator controlled radio transmitter means remotely disposed from said chassis for remotely controlling said drive motor, said steering means, and at least said volume control of said audio output means by radio signal input to said radio control receiver means.

15. The remote control model vehicle according to claim 14, further including:

a plurality of wheels extending from said chassis;

said wheels including at least one driven wheel and at least one directionally steerable wheel;

said remotely controllable drive motor selectively driving said at least one driven wheel; and said remotely controllable steering means selectively controlling said at least one directionally steerable wheel.

16. The remote control model vehicle according to claim 14, wherein said audio output means is selected from the group consisting of tape cassette players, CD players, and AM/FM radio receivers.

17. The remote control model vehicle according to claim 14, further including selectively operable forwardly and rearwardly disposed lighting means respectively simulating motor vehicle headlights and tail lights.

18. The remote control model vehicle according to claim 14, further including selectively operable audible horn means.

19. The remote control model vehicle according to claim 14, further including time display means.

* * * * *